US011421693B2

(12) United States Patent
Coghlan

(10) Patent No.: US 11,421,693 B2
(45) Date of Patent: Aug. 23, 2022

(54) PROGRESSING CAVITY DEVICE WITH CUTTER DISKS

(71) Applicant: Roper Pump Company, Commerce, GA (US)

(72) Inventor: Edmond Tate Coghlan, Talmo, GA (US)

(73) Assignee: Roper Pump Company, LLC, Wilmington, DE (US)

( * ) Notice: Subject to any disclaimer, the term of this patent is extended or adjusted under 35 U.S.C. 154(b) by 129 days.

(21) Appl. No.: 16/881,753

(22) Filed: May 22, 2020

(65) Prior Publication Data

US 2020/0284262 A1 Sep. 10, 2020

Related U.S. Application Data

(63) Continuation of application No. 15/724,362, filed on Oct. 4, 2017, now Pat. No. 10,662,950.

(Continued)

(51) Int. Cl.

| | |
|---|---|
| ***F01C 1/10*** | (2006.01) |
| ***F04C 2/10*** | (2006.01) |
| ***F04C 18/10*** | (2006.01) |
| ***F04D 17/04*** | (2006.01) |
| ***F04D 7/04*** | (2006.01) |

(Continued)

(52) U.S. Cl.

CPC ..... *F04D 7/045* (2013.01); *F01C 19/025* (2013.01); *F04C 2/1075* (2013.01); *F04C 13/004* (2013.01); *F04C 13/005* (2013.01); *F04D 29/2288* (2013.01); *F01C 1/101* (2013.01); *F01C 21/104* (2013.01); *F04C 13/008* (2013.01); *F04C 14/28* (2013.01); *F04C 2230/22* (2013.01); *F04C 2230/231* (2013.01);

(Continued)

(58) Field of Classification Search

CPC ..... F04D 7/045; F04D 2/1075; F01C 1/101; F04C 2/1071; F04C 18/1075

See application file for complete search history.

(56) References Cited

U.S. PATENT DOCUMENTS 3,975,121 A * 8/1976 Tschirky ..... E21B 4/02 418/48
4,144,001 A * 3/1979 Streicher ..... F04C 2/1075 418/153

(Continued)

*Primary Examiner* — Deming Wan

(74) *Attorney, Agent, or Firm* — Snyder, Clark, Lesch & Chung, LLP

(57) ABSTRACT

A stator for a helical gear device includes a first section having first helically convoluted chamber with a set of radially inwardly extending lobes and a second section adjacent to the first section. The second section includes a stack of cutter disks. Each cutter disk includes a front surface, a rear surface, an interior surface defining a central opening extending from the front surface to the rear surface, a forward cutting edge, and a rearward cutting edge. The interior surface forms a same number of lobes for the central opening as the set of radially inwardly extending lobes in the first section. Each cutter disk is aligned along a common centerline, and each cutter disk is rotated slightly relative to each other to form a second helically convoluted chamber with a same pitch as the first helically convoluted chamber. The second helically convoluted chamber exposes, to materials passing through, portions of the forward cutting edge or the rearward cutting edge of each cutter disk.

20 Claims, 13 Drawing Sheets

Related U.S. Application Data

(60) Provisional application No. 62/414,874, filed on Oct. 31, 2016.

(51) Int. Cl.

| | |
|---|---|
| ***F04D 29/22*** | (2006.01) |
| ***F01C 19/02*** | (2006.01) |
| ***F04C 13/00*** | (2006.01) |
| ***F04C 2/107*** | (2006.01) |
| *F01C 21/10* | (2006.01) |
| *F04C 14/28* | (2006.01) |

(52) U.S. Cl.
CPC ..... *F04C 2280/02* (2013.01); *F05B 2240/10* (2013.01); *F05C 2201/0448* (2013.01)

(56) References Cited

U.S. PATENT DOCUMENTS 5,832,604 A * 11/1998 Johnson ..... E21B 4/02 29/888.023
7,396,220 B2 * 7/2008 Delpassand ..... F04C 2/1075 418/153

* cited by examiner

PROGRESSING CAVITY DEVICE WITH CUTTER DISKS

CROSS-REFERENCE TO RELATED APPLICATION

This application is a continuation of U.S. patent application Ser. No. 15/724,362, filed Oct. 4, 2017, which claims priority from claims priority under 35 U.S.C. § 119, based on U.S. Provisional Patent Application No. 62/414,874 filed Oct. 31, 2016, the disclosures of which are incorporated by reference herein.

BACKGROUND OF THE INVENTION

The present invention relates to progressing cavity devices, and more particularly to stators of progressing cavity devices that can pass fluids containing solids.

Progressing cavity pumps are frequently used in applications to handle highly viscous fluids and fluids containing solids. Depending on the size and shape of the solids, the pump can frequently pass the solids through the pump if the solid is smaller than the cavity volume within the pump. If the solids are larger than the cavity then the solids can get jammed between the rotor and stator and cause the pump to lock up.

Power sections are used on directional drilling motors to provide the rotary motion to the drill bit as drilling mud is pumped through the power section. The usual failure mechanism for the power section stator is chunking of the rubber as it fatigues due to cyclic loading. The chunking usually commences at the end of the stator where the rotor is connected to the bearing assembly of the motor due to the sideload from the constant velocity joint or flex shaft. The chunking mechanism results in pieces of rubber breaking off of the rubber power section stator profile. These pieces of rubber can travel through the drilling motor and into the drill bit where they can plug the bit nozzles. If the bit nozzles become plugged then the drilling mud can no longer be pumped through the motor and the drilling operation has to stop resulting in costly downtime.

DETAILED DESCRIPTION OF THE PREFERRED EMBODIMENTS

The following detailed description refers to the accompanying drawings. The same reference numbers in different drawings may identify the same or similar elements.

Existing progressing cavity pumps and power sections do not have any mechanisms to break up solids that may need to pass through. In a progressing cavity pump, solids (such as rocks and debris) may be sucked into the pump and become jammed between the rotor and stator. Conversely in a power section, solids (such as rubber chunks from a section of a stator) may pass through an outlet of the stator and block nozzles or other downstream components.

According to an implementation described herein, cutting surfaces are included at an inlet of a progressing cavity pump. The cutting surfaces are included within a section of a stator made from multiple cutter disks to break up the solids into smaller pieces so they easily pass through the pump. The cutting action is created by the pump rotor orbiting within the cutter disks. Cutter disks may also be included at the outlet of the pump to further break up the solids for easier passage through the rest of a system after the pump.

According to another implementation, cutting surfaces are included at an outlet of a power section. The cutting surfaces are included within a section of a stator made from multiple cutter disks to break up any rubber chunks into smaller pieces so they can pass through the drill bit nozzles without plugging the drill bit. The cutting action is created by the power section rotor orbiting within the cutter disks. Cutter disks may also be included at the inlet of the power section to further break up any solids that may be in the drilling mud system to aid the solids passing through the power section, motor and drill bit.

Figure 1A:
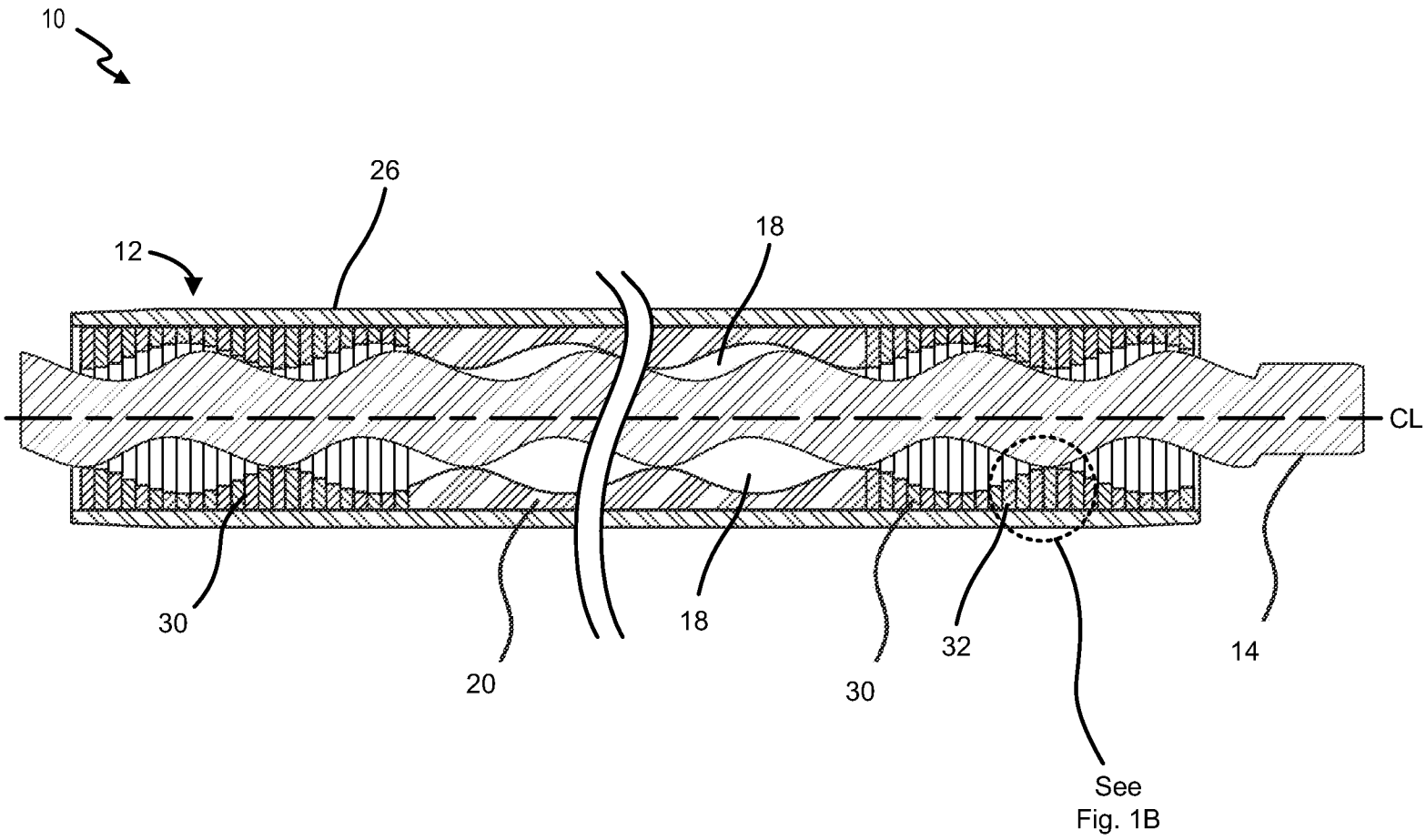
FIG. 1A is a partial, longitudinal cross-sectional view of an exemplary stator with cutter disks, applied over a portion of a pump rotor, according to an implementation described herein.
Figure 1B:
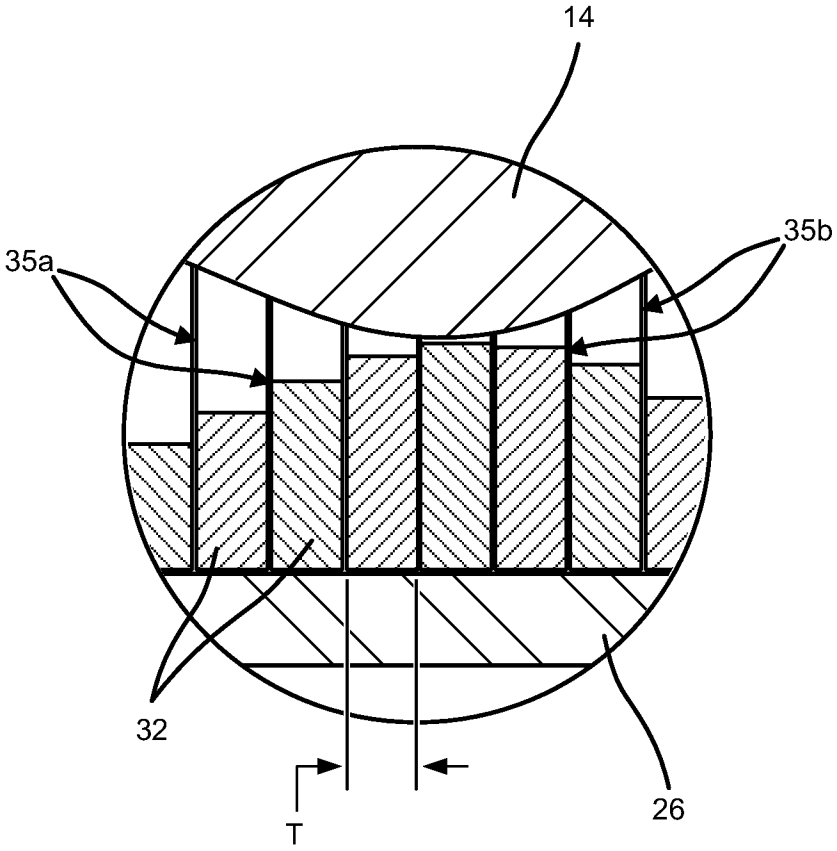
FIG. 1B is an enlarged view of a portion of the stator of FIG. 1A.

FIG. 1A depicts a partial, longitudinal cross-sectional view of an exemplary stator 12 with cutter disks, applied over a portion of a pump rotor 14. FIG. 1B is an enlarged view of a portion of FIG. 1A. In one implementation, stator 12 and rotor 14 may correspond to a progressing cavity pump section 10. Pump section 10 is shown with elongated helically lobed rotor 14 extended through stator 12. Stator 12 is also a helically lobed structure preferably having at least one more lobe than the rotor. In the configuration of FIGS. 1A and 1B, for example, pump 10 is a helical gear pump including an internal gear (stator 12) with a double lobe and an external gear (rotor 14) with a single lobe (e.g., a circular transverse cross-section). The meshing of stator 12 and rotor 14 forms a cavity 18, which progresses along the axis (e.g., centerline CL) of the pump section 10 assembly as rotor 14 is rotated.

Stator 12 includes at least one working stator section 20 and at least one cutting stator section 30 housed within a cylindrical outer housing or stator casing 26. In the example of FIG. 1A, a cutting stator section 30 is shown on both sides of the working stator section 20. Working stator section 20 and cutting stator sections 30 may be axially aligned within stator casing 26.

Working stator section 20 may include multiple helical lobes that generally conform to a profile of rotor 14. In one implementation, working stator section 20 includes an elastically deformable elastomeric material, such as rubber, with an even or smooth profile. When using the elastically deformable elastomeric material, working stator section 20 may be dimensioned so that the helical lobes of working stator section 20 form an interference fit, relative to rotor 14, under expected operating conditions. Stator 12 and rotor 14 thereby form continuous seals along their matching contact points which define the progressing cavities 18. As shown in FIG. 1A, working stator section 20 is bonded to the stator casing 26, and each cutting stator section 30 may be bonded to working stator section 20 and stator casing 26.

Figure 2A:
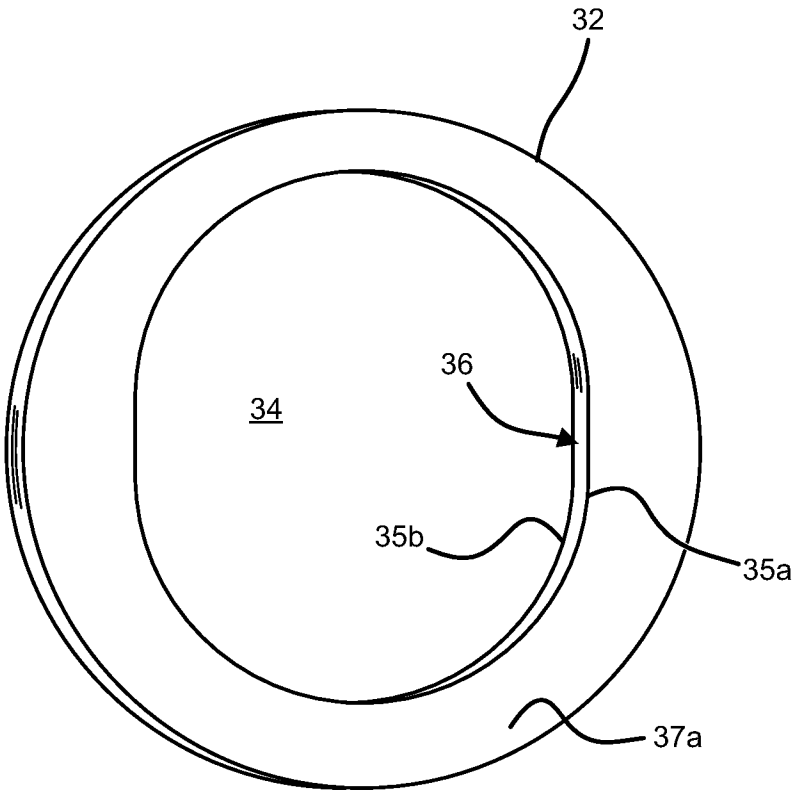
FIG. 2A is a perspective end view of an exemplary cutter disk of the stator of FIG. 1A.
Figure 2D:
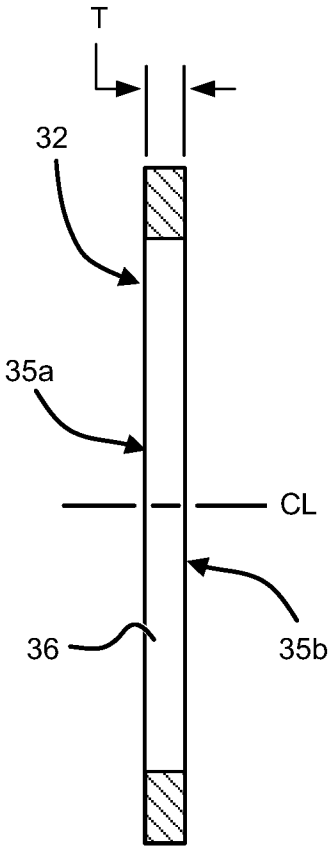
FIG. 2D is a cross-sectional view of the cutter disk along section A-A of FIG. 2B.
Figure 2C:
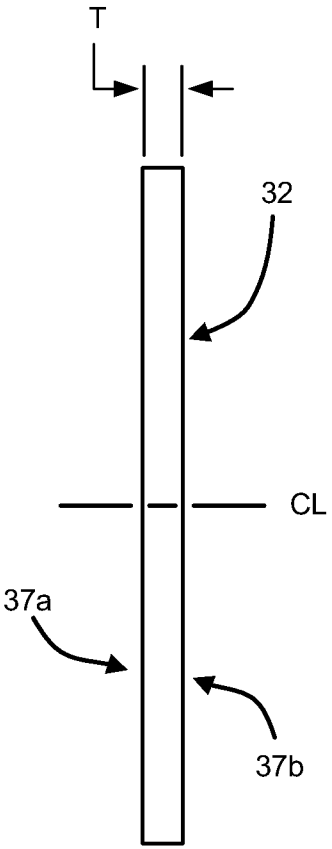
FIG. 2C is a side view of the cutter disk of FIG. 2A.
Figure 2B:
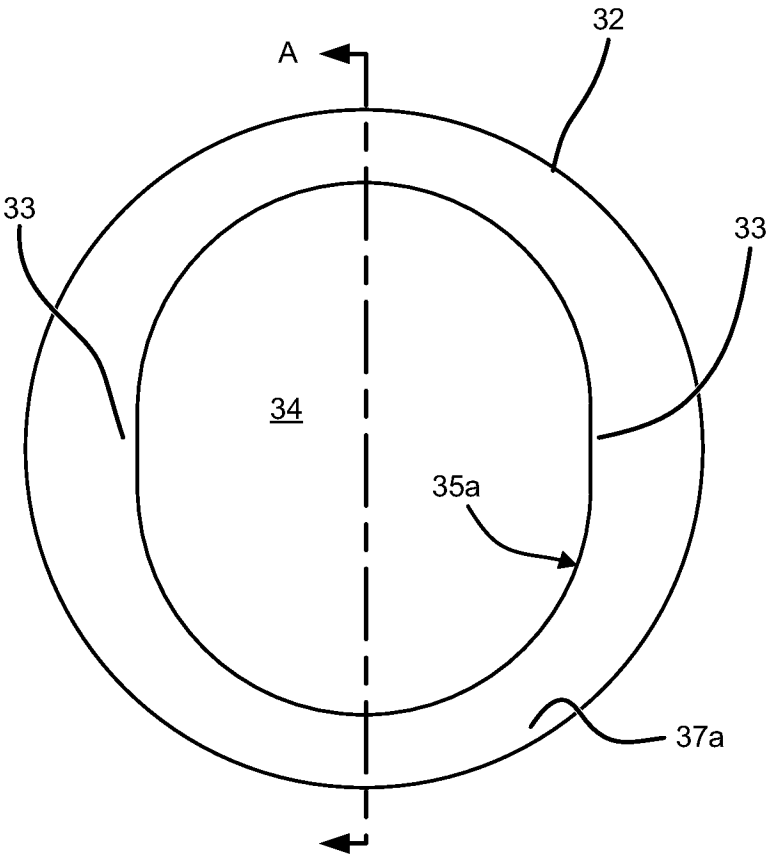
FIG. 2B is an end view of the cutter disk of FIG. 2A.

Cutting stator section 30 includes multiple like-shaped lobed cutter disks 32. As can best be seen in FIG. 2A-2D, each cutter disk 32 includes a central opening 34 with an exemplary disk 32 having two symmetrical lobes 33 radially extending toward centerline CL. As shown, for example in FIG. 2B, opening 34 may thus be in the form of two semi-circles separated by a rectangle, where the size of the rectangular separation is proportional to the offset (or eccentricity) of rotor 14. In one implementation, all of cutter disks 32 have substantially identical construction and dimension.

As shown in FIG. 1A, cutter disks 32 may be stacked together to form cutting stator section 30. In the stacked configuration, each of cutter disks 32 may be aligned along a common centerline (CL) with each disk being rotated slightly from the disks on either side (e.g., creating a small angular difference between the disks, such as a 5° to 25° difference) such that the adjacent openings 34 form a helical winding inside stator casing 26. In implementations described herein, one cutting stator section 30 provides a continuous profile geometry (e.g., helical winding) of the stator 12 into working stator section 20 and another cutting stator section 30 provides a continuous profile geometry of the stator 12 out of working stator section 20. In one implementation, the rigid cutting stator sections 30 do not fit as tightly around rotor 14 as the elastically deformable working stator section 20. For example, since cutter disks 32 are rigid, cutting stator section 30 may not include an interference fit. In another example, cutting stator section 30 may include a nominal clearance around rotor 14.

Cutter disks 32 may be placed into the helical configuration of cutting stator section 30 by stacking cutter disks 32 onto an alignment assembly via means for stacking, including an alignment mandrel/core with a profile that catches lobes 33 of the disks with its profile cut in a helical pattern in the alignment core. Cutter disks 32 may also be aligned with an alignment assembly including a jig which interacts with disk features other than the inner profile or through features built into the disks (e.g., apertures through the disk lobes) that rotate each disk slightly (e.g., approximately 15°) relative to neighboring disks.

Each of cutter disks 32 may include a forward edge 35*a* and a rearward edge 35*b* (referred to collectively as "edges 35" or generically as "edge 35") extending along a perimeter of opening 34. Each of cutter disks 32 may have a thickness, T, which also defines a depth of the opening 34 through each cutter disk 32. A surface 36 along the interior of opening 34 extends in the convoluted shape for the thickness T when measured in a direction parallel to the common centerline.

Figure 3B:
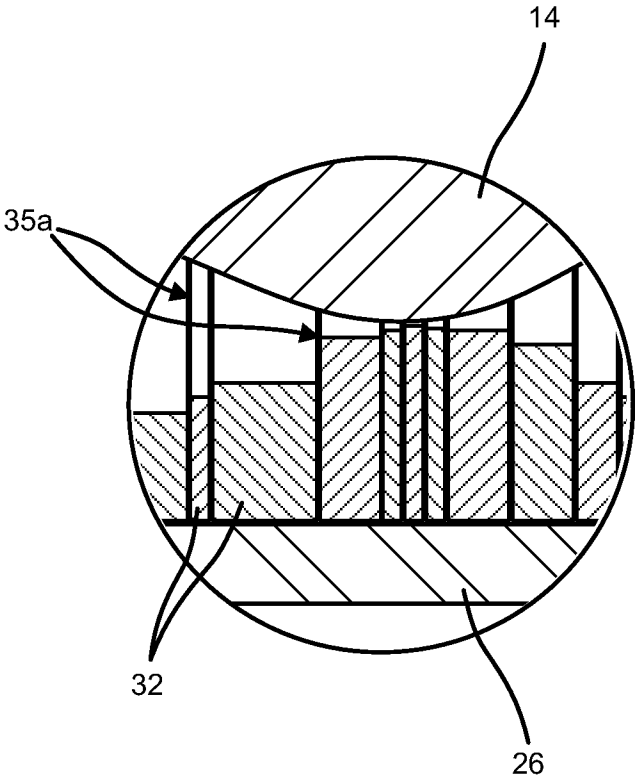
FIG. 3B is an enlarged view of the portion of the stator of FIG. 1B, according to another alternate implementation.

The thickness of the disks determines the size of the step between edges 35 as they are aligned into the desired helical formation—the thicker the disk, the larger the step. As shown, for example, in FIGS. 1A and 1B, the thickness T of interior surface 36 is substantial enough to form a stepped configuration of edges 35, which exposes portions of edges 35 to promote cutting, when cutter disks 32 are arranged into the helical configuration of cutting stator section 30 and aligned to accept the profile of rotor 14. Thickness T may also be sized to resist deformation (bending) of cutter disks 32. Thickness T may be in the range of 0.1 inches to 1.0 inches or more. In one example, thickness T may be at least 0.25 inches. In another example, thickness T may be at least 0.5 inches. In still another implementation, different cutter disks 32 within cutting stator section 30 may have different thickness. For example, as shown in FIG. 3B and described further below, in another embodiment, disks 32 may have different thicknesses and form irregular steps. In the example of FIG. 3B, some of cutter disks 32 may have a thickness in the range of 0.1 inches to 1.0 inches or more, while other cutter disks 32 may have a smaller thickness.

Forward edge 35*a* is formed at the intersection of interior surface 36 and a side surface 37*a* (also referred to as a front surface), while rearward edge 35*b* is formed at the intersection of interior surface 36 and an opposite side surface 37*b* (also referred to as a rear surface). In one implementation, side surface 37*a* and side surface 37*b* may define parallel planes, with interior surface 36 being perpendicular to each of side surface 37*a* and side surface 37*b* along the entire perimeter of opening 34. The slight rotation of cutter disks 32, relative to each other, around the centerline within the helical configuration of cutting stator section 30 exposes different portions of edges 35. The exposed edges 35 may function as cutting edges. For example, in the cross-sectional portion of FIG. 1B, edges 35*a* may be exposed to fluids and particulates at one portion along the length of cutting stator section 30, and edges 35*b* may be exposed to fluids and particulates at another portion along the length of cutting stator section 30.

Cutter disks 32 may be manufactured in a variety of ways, with preferred methods including machining via laser, water jet, electrical discharge machining (EDM), milling etc. or a stamping/punching process. They may also be made to shape originally by casting, powder metallurgy or any similar process. In one implementation, cutter disks 32 may be formed from metal, such as a hardened tool steel from one of the American Iron and Steel Institute (AISI) grades of tool steel. In other implementations, a different material may be used to form disks 32. Cutter disks 32, and particularly edges 35, may be sufficiently hard to engage and break up particulates forced between edges 35 and rotor 14. A driving force behind the method of disk manufacture is the disk material and the cost of manufacture for that material. For example stamping is cost effective for some disks made of metals but unfeasible for disks made of ceramics.

In some cases it is necessary to tighten the alignment of cutter disks 32 in cutting stator section 30 by the application of force to the outer diameter of the stack by, for example, swaging, v-blocking or hammering in either a static or rotating condition. Cutting stator section 30 is set by fixing the rigid cutter disks 32 together with a bond provided by, for example, welding, fusing, soldering, brazing, sintering, diffusion bonding, mechanical fastening, or via an adhesive bond. The stator casing 26, which preferably is made of metal, may be straightened, chamfered, machined, cleaned and heated as required. Stator casing 26 is another bonding member that may then be slid over cutting stator section 30 and bonded together (e.g., welding, fusing, soldering, brazing, sintering, diffusion bonding, mechanical fastening, adhesive) to further fix the rigid cutter disks 32 together. The alignment assembly may then be removed from the disk stack 30. Depending on the disk stack alignment methodology, it may be required or preferred to insert the disk stack 30 into stator casing 26 without the alignment tooling entering stator casing 26 as well.

Figure 3A:
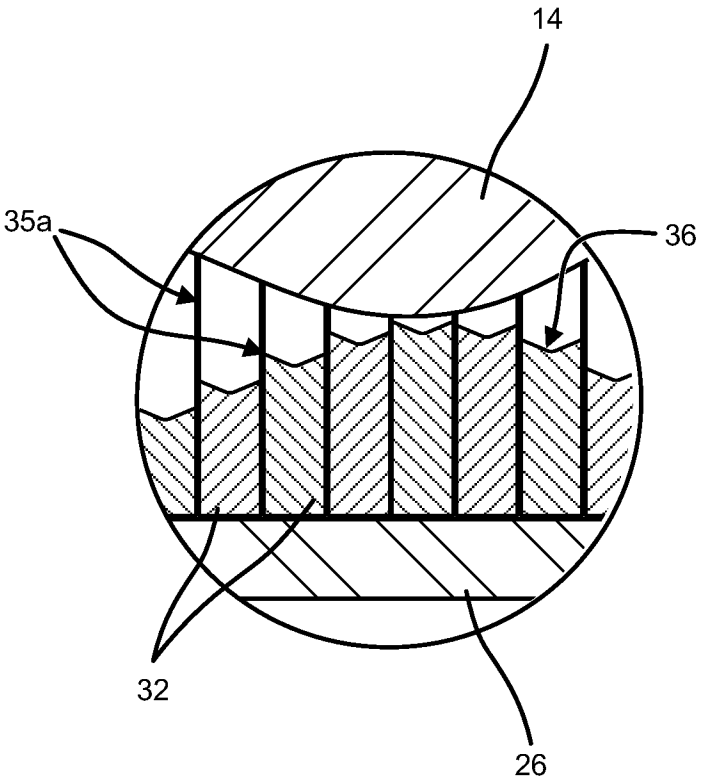
FIG. 3A is an enlarged view of the portion of the stator of FIG. 1B, according to an alternate implementation.

FIG. 3A depicts the enlarged view of FIG. 1B, showing an alternate implementation of cutter disks 32. In the configuration of FIG. 3A, interior surface 36 of each disk 32 has a concave contour along the thickness of disk 32. The contour of surface 36 may, for example, create sharper cutting edges (e.g., forward edges 35*a* shown in FIG. 3A) where edges 35 are exposed by the helical configuration of cutting stator section 30.

FIG. 3B the enlarged view of FIG. 1B, showing another alternate implementation of cutter disks 32. As shown in FIG. 3B, different disks 32 of cutting stator section 30 may have different thicknesses. The different thicknesses may expose edges 35 at different intervals (e.g., different step sizes). For example, disks 32 with different thicknesses may be staggered in an irregular order within cutting stator section 30. In another example, disks 32 with different thicknesses may be stacked to gradually increase or decrease the step sizes between edges 35 in the direction of fluid flow through cutting stator section 30.

Figure 4:
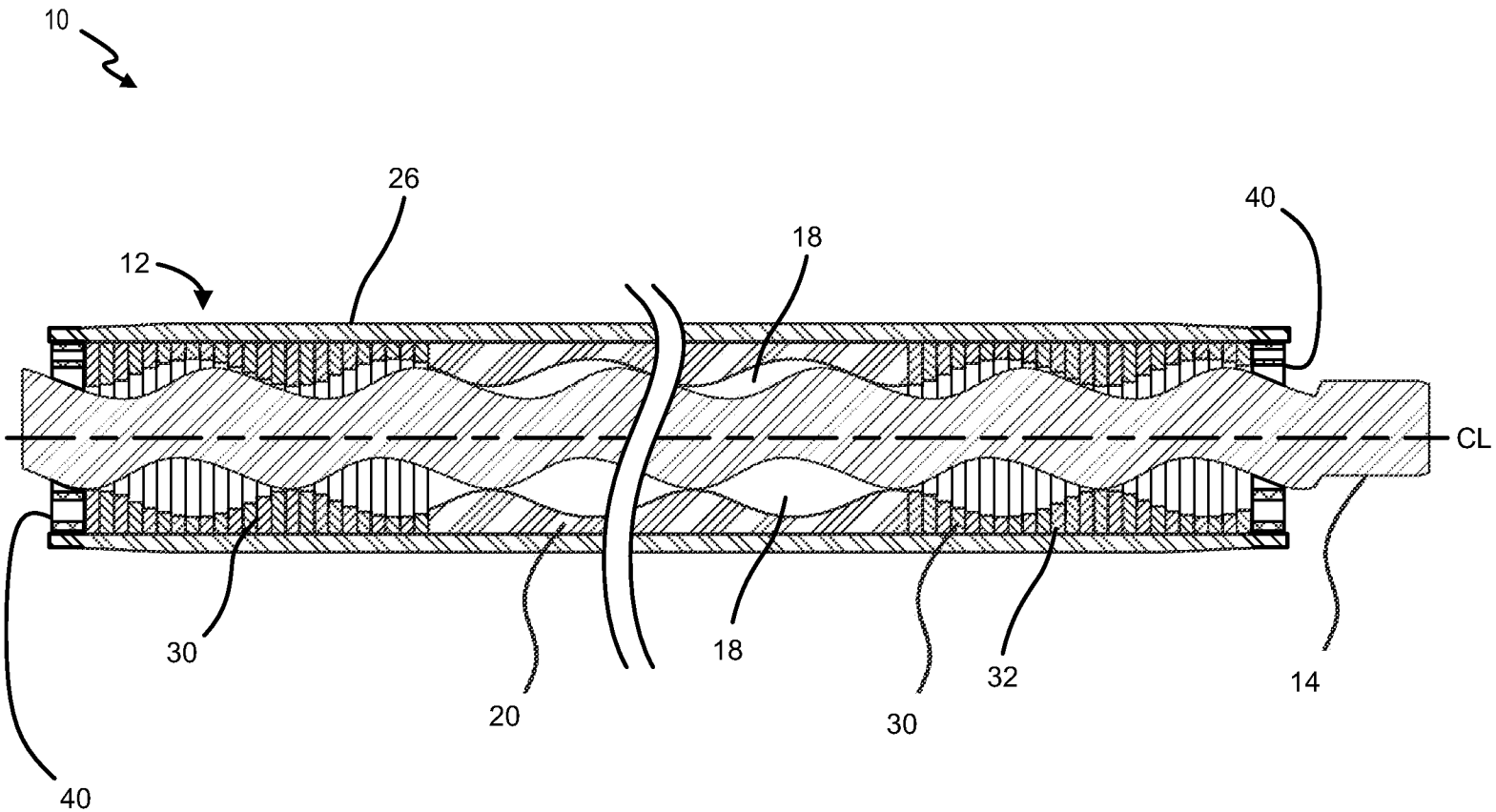
FIG. 4 is a partial, longitudinal cross-sectional view of the stator of FIG. 1A with cutter disks and support rings, applied over a portion of the pump rotor.

FIG. 4 depicts a partial, longitudinal cross-sectional view of an exemplary stator 12, similar to FIG. 1, but with added retention rings 40. Retention rings 40 provide added support of rotor 14 during operation of pump section 10. Each retention ring 40 may form a cylindrical chamber section or aperture and may be sized so that during operation, the rotor 14 orbit touches an inner diameter of the retention ring 40 and is thereby supported. Retention rings 40 may be bonded to the inside surface of the stator casing 26 by for example, welding, fusing, soldering, brazing, sintering, diffusion bonding, mechanical fastening, or via an adhesive bond. In one implementation, the inner diameter of retention ring 40 may be slightly smaller than a major diameter of central opening 34 of cutting stator section 30, so as to minimize contact of cutter disks 32 (e.g., edges 35) with rotor 14. In another implementation, the inner diameter of retention ring 40 may be equal to the major diameter of central opening 34. Although a retention ring 40 is shown at each end of stator casing 26 in FIG. 4, in other implementations, a retention ring 40 may be used at only one end of stator casing 26.

Figure 5:
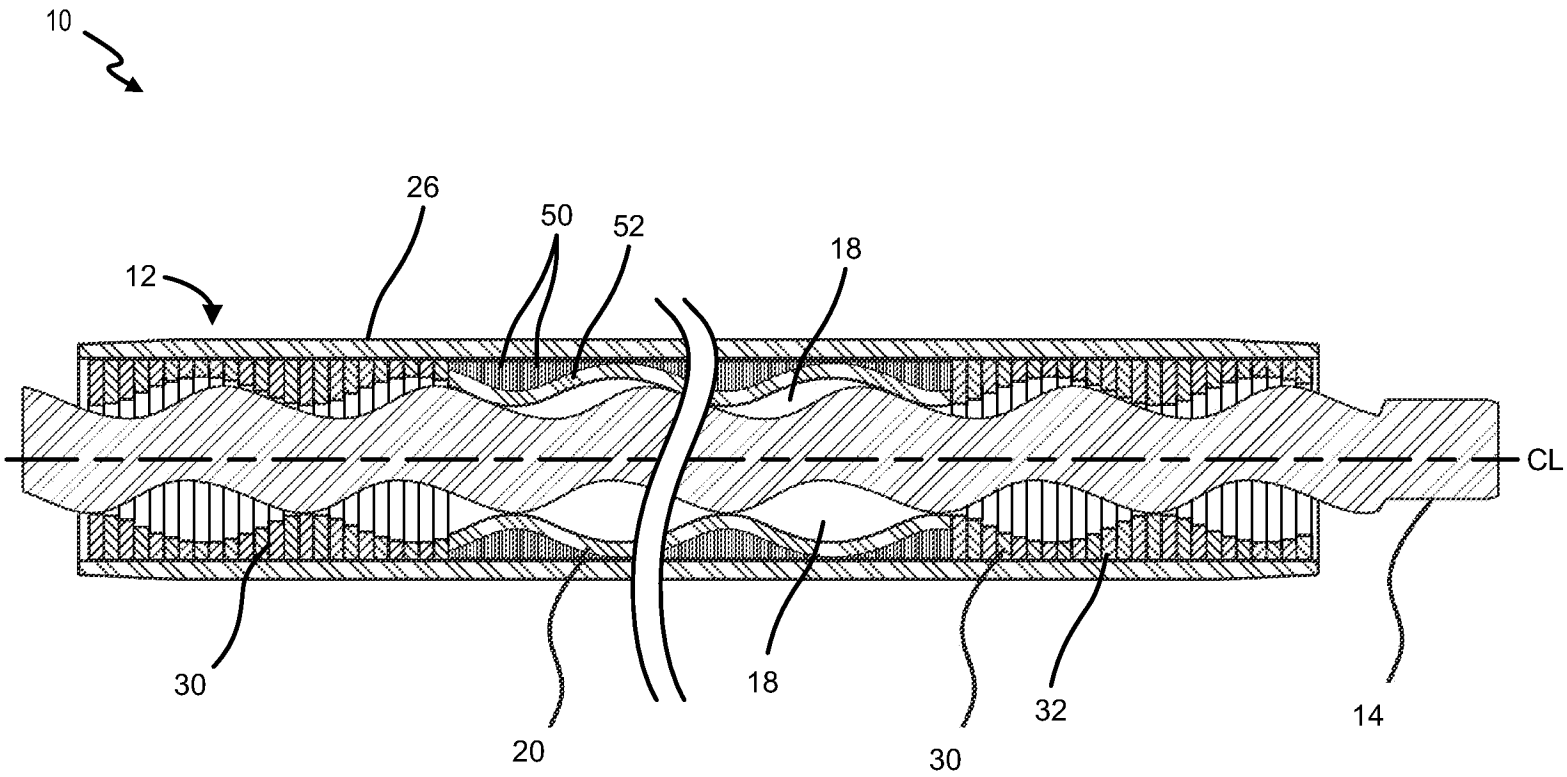
FIG. 5 is a partial, longitudinal cross-sectional view of an exemplary hybrid stator with cutter disks, applied over a portion of the pump rotor.

FIG. 5 depicts a partial, longitudinal cross-sectional view of an exemplary stator 12, similar to FIG. 1, but with a hybrid working stator section 20. As shown in FIG. 5, hybrid working stator section 20 may include a rigid stack of support disks 50 and an elastically deformable liner 52 within stator casing 26. In contrast with cutter disks 32, support disks 50 may be significantly thinner (e.g., 0.040 inches) than cutter disks 32. For example, in one implementation, cutter disks 32 may be ten times thicker than support disks 50. Thus, support disks 50 may more closely conform to the profile of rotor 14 than cutter disks 32 in cutting stator section 30. Support disks 50 may be formed from a metal material (e.g., steel) or another rigid material and include a convoluted opening for rotor 14 to pass through. In one implementation, support disks 50 may be made from the same material as cutter disks 32. In other implementations, support disks 50 may use a different (e.g., less expensive) metal than the hardened metal used for cutter disks 32. Liner 52 may include an elastically deformable elastomeric material, such as rubber, with an even or smooth profile.

Figure 6:
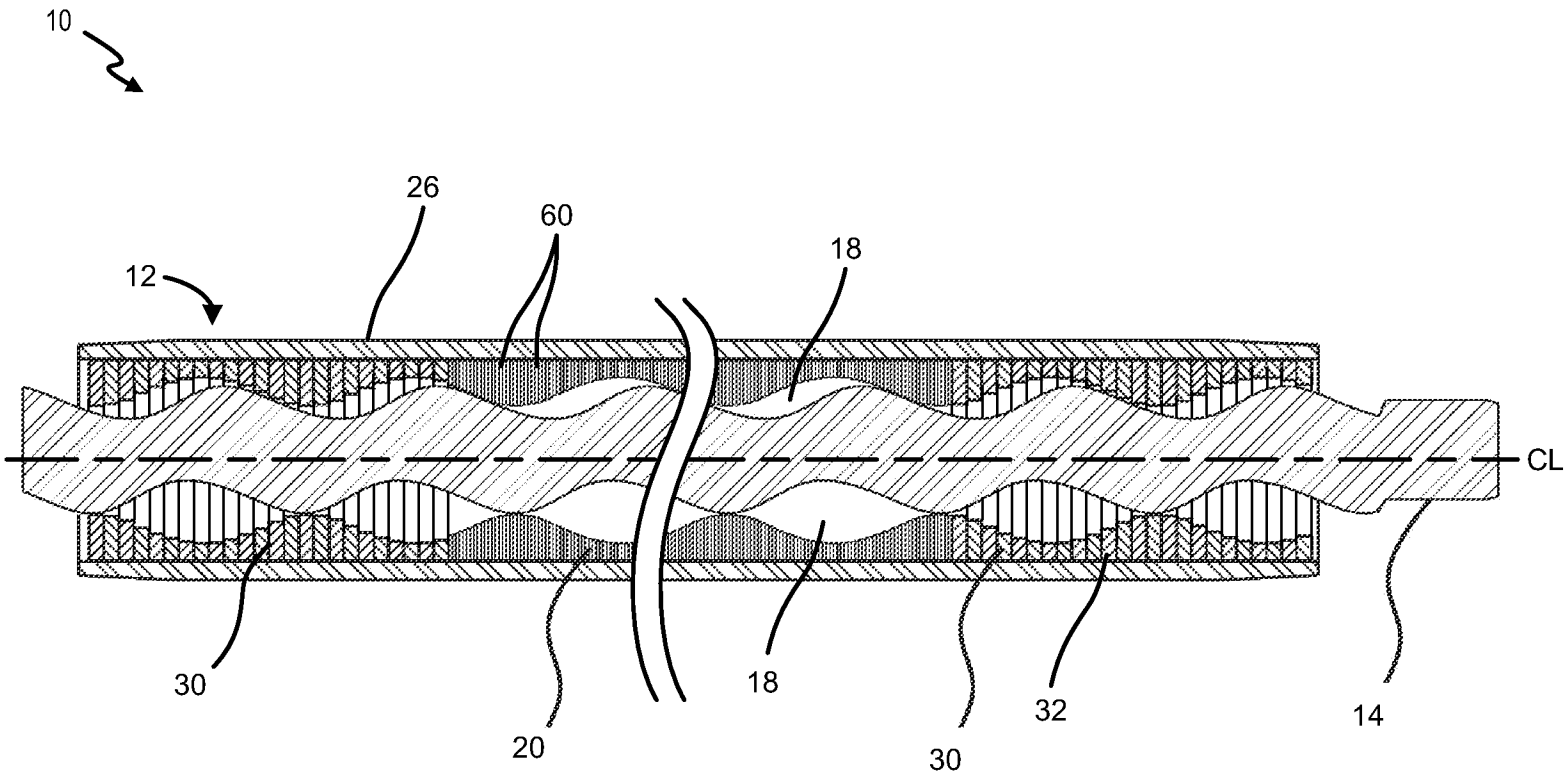
FIG. 6 is a partial, longitudinal cross-sectional view of an exemplary metal-on-metal stator with cutter disks, applied over a portion of the pump rotor.

FIG. 6 depicts a partial, longitudinal cross-sectional view of an exemplary stator 12, similar to FIG. 1, but with a metal-on-metal working stator section 20. As shown in FIG. 6, metal-on-metal working stator section 20 may include a rigid stack of support disks 60 within stator casing 26. Support disks 60 may be similar to support disks 50 described above in connection with FIG. 5. However, each of support disks 60 may be configured with a slightly smaller opening (e.g., smaller major diameter) than support disks 50, such that support disks 60 may more closely match the profile of rotor 14 without use of a liner.

Figure 7:
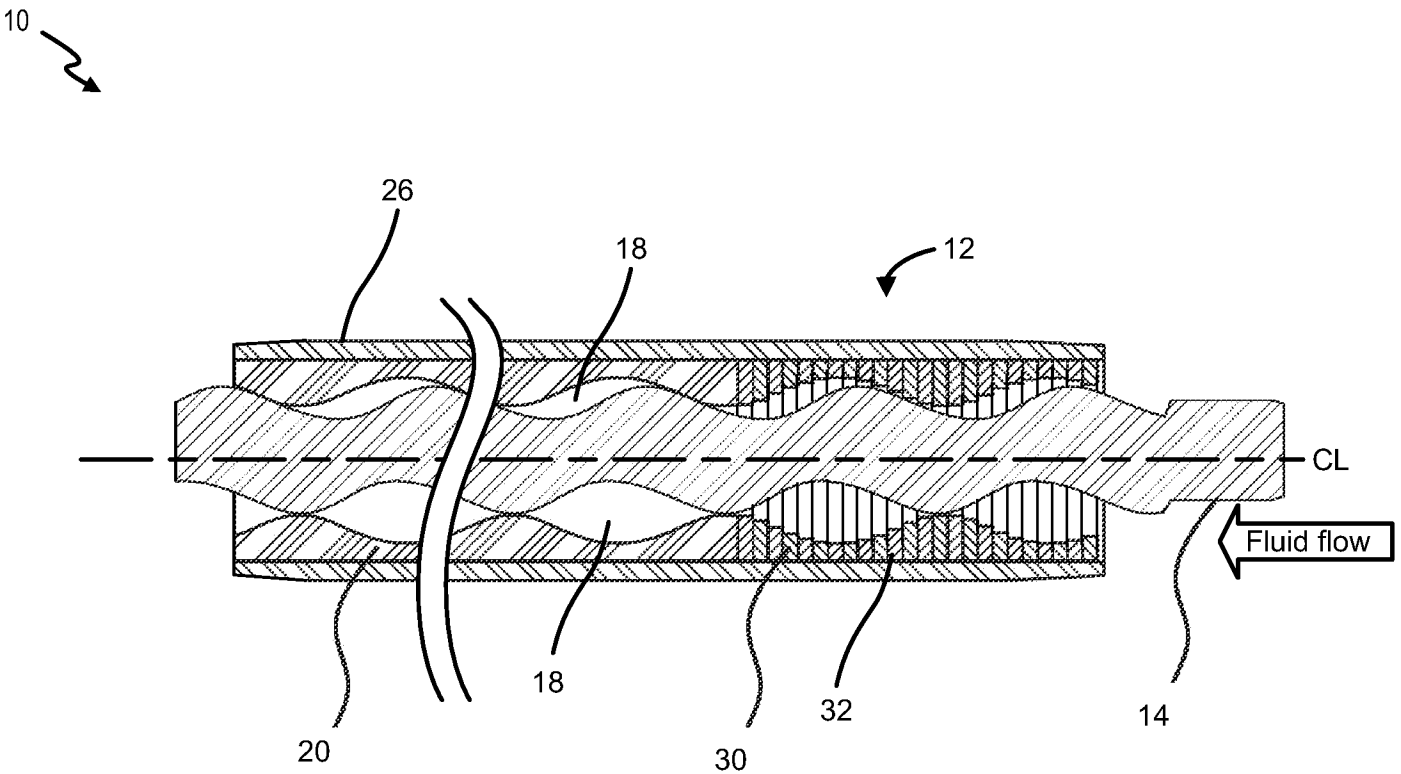
FIG. 7 is a partial, longitudinal cross-sectional view of an exemplary stator with a single set of cutter disks, applied over a portion of the pump rotor of FIG. 1.

FIG. 7 depicts a partial, longitudinal cross-sectional view of an exemplary stator 12, similar to FIG. 1, but with a single cutting stator section 30. In the configuration of FIG. 7, cutting stator section 30 may be located upstream of working stator section 20 (e.g., at an inlet of pump section 10) such that edges 35 (e.g., FIG. 1B) of cutter disks 32 can break up larger solids (e.g., debris) that may otherwise pass into working stator section 20.

Figure 8:
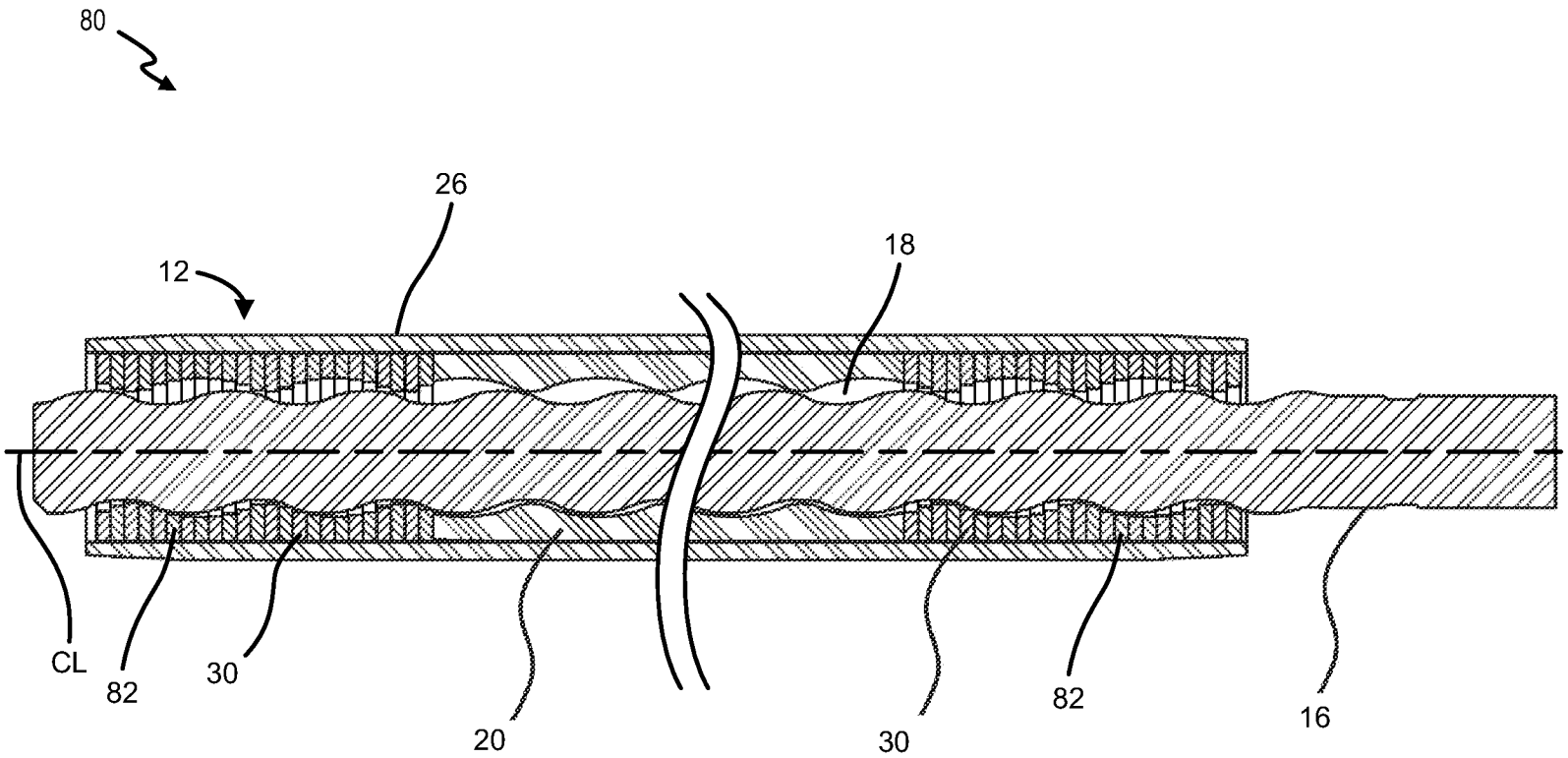
FIG. 8 is a partial, longitudinal cross-sectional view of an exemplary stator with cutter disks, applied over a portion of a power section rotor, according to an implementation described herein.

FIG. 8 depicts a partial, longitudinal cross-sectional view of an exemplary stator 12 with cutter disks, applied over a portion of a power section rotor 16. In one implementation, stator 12 and rotor 16 may correspond to a power section 80 of a hydraulic motor. Power section 80, for example, may have a principal use as a drilling motor for downhole oil well or slurry applications. Power section 80 is shown with an elongated helically lobed rotor 16 extended through a stator 12. Stator 12 is also a helically lobed structure preferably having at least one more lobe than the rotor, which creates cavity 18 between the rotor 16 and stator 12 along the longitudinal length there between. Cavity 18 progressively moves along the longitudinal length between rotor 16 and stator 12 as rotor 16 rotates within stator 12. Fluid, forced into cavity 18 from one end of the rotor to the other, causes rotor 16 to rotate within stator 12.

Figure 9A:
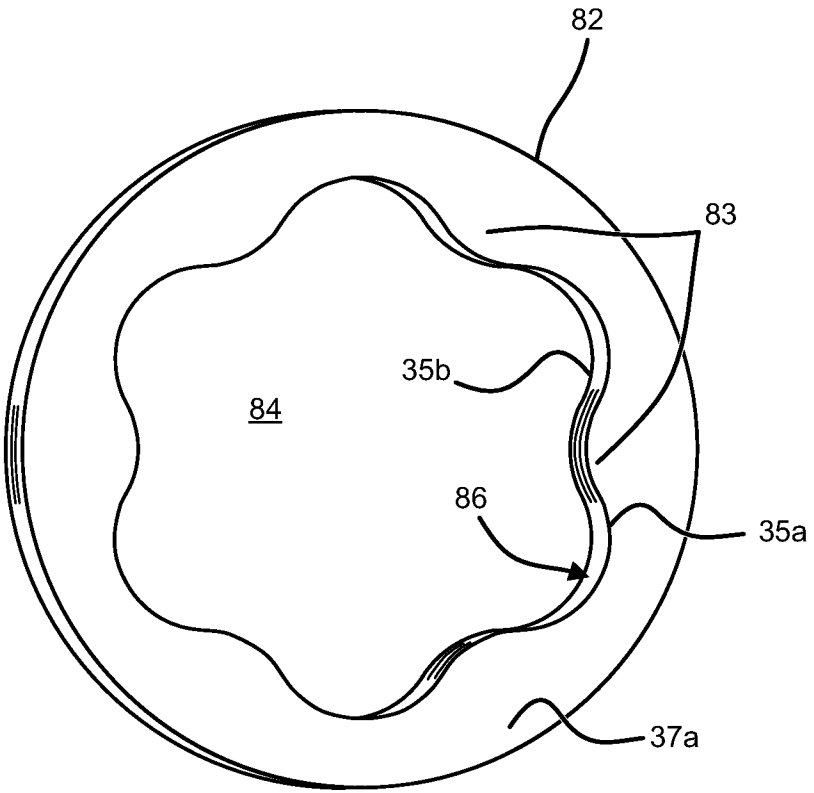
FIG. 9A is a perspective end view of an exemplary cutter disk of the stator of FIG. 8.
Figure 9D:
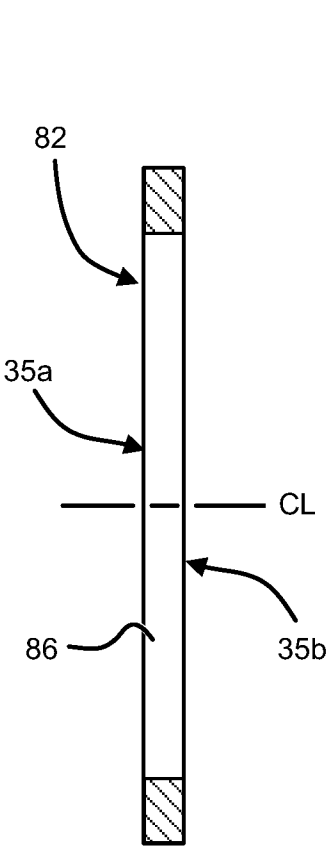
FIG. 9D is a cross-sectional view of the cutter disk along section A-A of FIG. 9B.
Figure 9C:
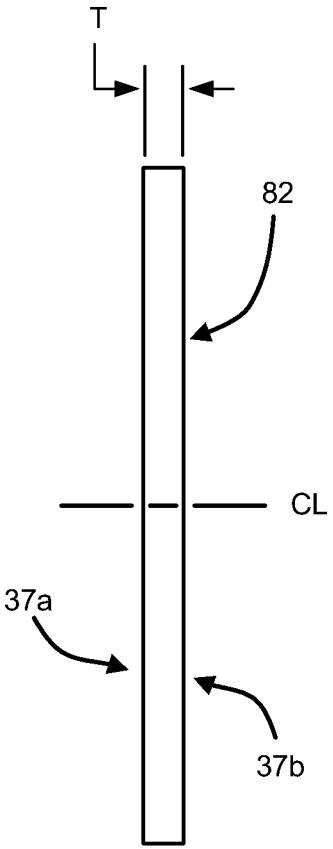
FIG. 9C is a side view of the cutter disk of FIG. 9A.
Figure 9B:
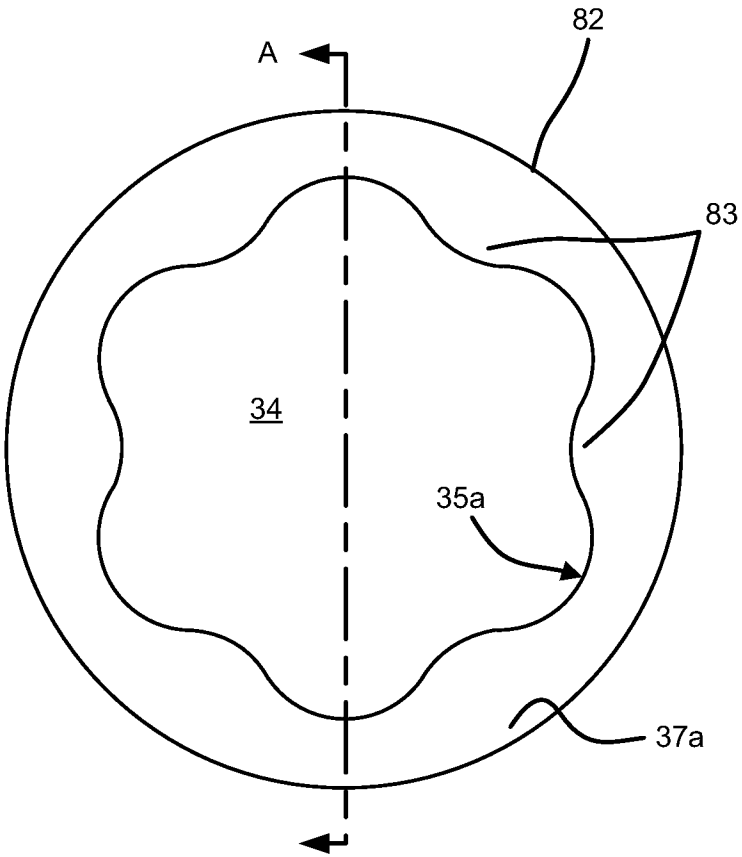
FIG. 9B is an end view of the cutter disk of FIG. 9A.

Cutting stator section 30 includes multiple like-shaped lobed cutter disks 82. As can best be seen in FIG. 9A-9D, each cutter disk 82 includes a convoluted opening 84 with an exemplary disk having a number of equally spaced symmetrical lobes 83 radially extending toward the centerline. While six lobes 83 are shown in the configuration of FIGS. 9A-9B (e.g., to accommodate a five-lobe rotor 16), other lobe configurations may be used. In one implementation, all of cutter disks 82 have substantially identical construction and dimension. In other implementations, cutter disks 82 may have different thicknesses, while maintaining a consistent shape of opening 84.

As shown in FIG. 8, cutter disks 82 in cutting stator section 30 may share a common centerline (CL) with each disk rotated slightly from the disks on either side to form a helical winding inside stator casing 26. In implementations described herein, one cutting stator section 30 provides a continuous profile geometry (e.g., helical winding) of the stator 12 into working stator section 20 and another cutting stator section 30 provides a continuous profile geometry of the stator 12 out of working stator section 20. In one implementation, the rigid cutting stator sections 30 do not fit as tightly around rotor 14 as the rubber-lined working section 20. In other words, the size of each opening 84 may be slightly larger than a opening of a corresponding transverse cross-section of working section 20.

Similar to cutter disks 32 described above, cutter disks 82 may be placed into the helical configuration of cutting stator section 30 by stacking cutter disks 82 onto an alignment assembly. Each of cutter disks 82 may include a forward edge 35*a* and a rearward edge 35*b* extending along a perimeter of opening 84. Each of cutter disks 82 may have a thickness, T, which also defines a depth of the opening 84 through each cutter disk 82. A surface 86 along the interior of opening 84 extends in the convoluted shape of opening 84 for the thickness T. Forward edge 35*a* is formed at the intersection of interior surface 86 and a side surface 37*a*, while rearward edge 35*b* is formed at the intersection of interior surface 86 and opposite side surface 37*b* (not visible in figures). The slight rotation of cutter disks 82, relative to each other, around the centerline within the helical configuration of cutting stator section 30 exposes different portions of edges 35. The exposed edges 35 may function as cutting edges.

Figure 10:
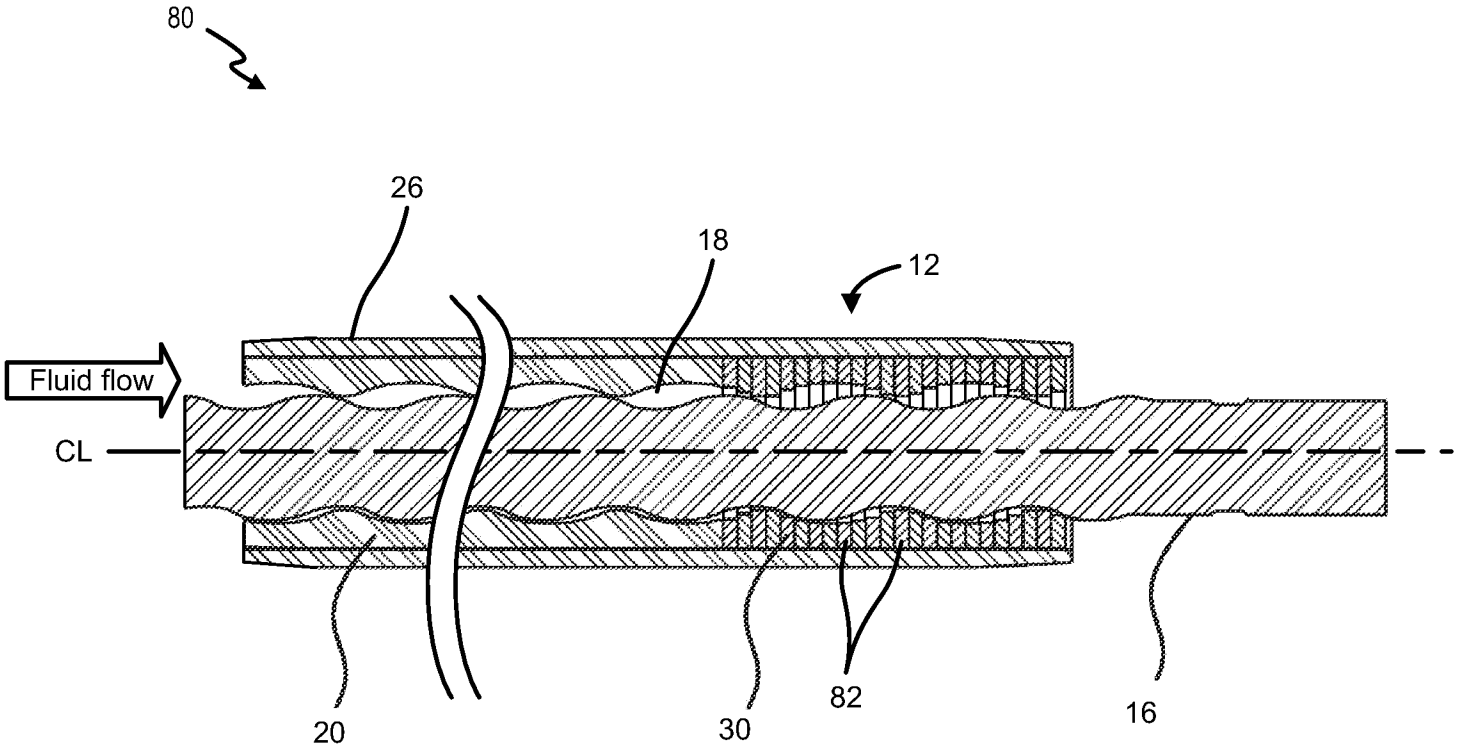
FIG. 10 is a partial, longitudinal cross-sectional view of an exemplary stator with a single set of cutter disks, applied over a portion of the power section rotor of FIG. 8.

FIG. 10 depicts a partial, longitudinal cross-sectional view of an exemplary stator 12, similar to FIG. 8, but with a single cutting stator section 30. In the configuration of FIG. 10, cutting stator section 30 may be located downstream of working stator section 20 (e.g., at an outlet of power section 80) such that edges 35 of cutter disks 82 can break up rubber chunks or debris that may pass out of working stator section 20.

In implementations described herein, a stator for a helical gear device includes a first (or "working") section having first helically convoluted chamber with a set of radially inwardly extending lobes and a second (or "cutting") section adjacent to, and axially aligned with, the first section. The second section includes a stack of cutter disks. Each of the cutter disks includes a front surface, a rear surface, an interior surface defining a central opening extending from the front surface to the rear surface, a first cutting edge along the front surface and the interior surface (also referred to as the forward edge), and a second cutting edge along the rear surface and the interior surface (also referred to as the rearward edge). The interior surface forms a same number of lobes for the central opening as the set of radially inwardly extending lobes in the first section. Each of the cutter disks is aligned along a common centerline, and each of the cutter disks is rotated slightly relative to each other such that the stack of cutter disks forms a second helically convoluted chamber with a same pitch as the first helically convoluted chamber. The second helically convoluted chamber in the stack of the cutter disks exposes, to materials passing through the second helically convoluted chamber, portions of the first cutting edge or the second cutting edge of each of the cutter disks.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

Although the invention has been described in detail above, it is expressly understood that it will be apparent to persons skilled in the relevant art that the invention may be modified without departing from the spirit of the invention. Various changes of form, design, or arrangement may be made to the invention without departing from the scope of the invention. Different combinations illustrated above may be combined in a single embodiment. For example, any of the arrangements or types of working section 20 shown in connection with progressing cavity pump section 10 (e.g., FIGS. 3-7) may similarly be used in power section 80. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A stator for a helical gear device, comprising:

a first section including a stack of cutter disks, each of the cutter disks including:

a front surface, a rear surface, an interior surface defining a central opening extending from the front surface to the rear surface, a first cutting edge along the front surface and the interior surface, and a second cutting edge along the rear surface and the interior surface, wherein the interior surface has a concave contour between the first cutting edge and the second cutting edge, the interior surface forming a same number of lobes for the central opening as a set of radially inwardly extending lobes, each of the cutter disks being aligned along a common centerline, and each of the cutter disks being rotated slightly relative to each other such that the stack of cutter disks forms a first helically convoluted chamber with the set of radially inwardly extending lobes, wherein the first helically convoluted chamber in the stack of cutter disks exposes, to materials passing through the first helically convoluted chamber, portions of the first cutting edge or the second cutting edge of each of the cutter disks.

2. The stator of claim 1, further comprising:

a second section including a second helically convoluted chamber with a same pitch as the first helically convoluted chamber, and a cylindrical outer housing to which the first section and the second section are secured.

3. The stator of claim 2, wherein the first section is upstream of the second section.

4. The stator of claim 2, wherein the first section is downstream of the second section.

5. The stator of claim 2, wherein the second section includes an elastically deformable elastomeric material.

6. The stator of claim 2, wherein the second section includes a plurality of metal disks, the metal disks having a smaller thickness then the cutter disks.

7. The stator of claim 1, wherein the interior surface comprises a V-shape between the first cutting edge and the second cutting edge.

8. The stator of claim 1, wherein the first section further comprises:

a bonding member fixedly attached to the cutter disks to bond the cutter disks together as the stack.

9. The stator of claim 1, wherein the cutter disks include metal disks.

10. The stator of claim 9, wherein the cutter disks include hardened tool steel.

11. The stator of claim 1, wherein the cutter disks have a thickness between 0.1 inches and 1 inch.

12. The stator of claim 1, further comprising:

a rigid retention ring fixedly attached to an end of the stack, the rigid retention ring having a central aperture being circular in cross-section and having a constant diameter, the constant diameter of the central aperture of the rigid retention ring being substantially equal to another major diameter of a rotor, the rigid retention ring supporting the rotor disposed in the first helically convoluted chamber.

13. A helical gear device, comprising:

a rotor including one or more radially outwardly extending helical lobes; and a stator including:

a first section including a stack of cutter disks, each of the cutter disks including:

a front surface, a rear surface, an interior surface defining a central opening extending from the front surface to the rear surface, a first cutting edge along the front surface and the interior surface, and a second cutting edge along the rear surface and the interior surface, wherein the interior surface has a concave contour between the first cutting edge and the second cutting edge, the interior surface forming a same number of lobes for the central cavity as a set of radially inwardly extending lobes, each of the cutter disks being aligned along a common centerline, and each of the cutter disks being rotated slightly relative to each other such that the stack of cutter disks forms a first helically convoluted chamber with the set of radially inwardly extending lobes, wherein the first helically convoluted chamber in the stack of cutter disks exposes, to materials passing through the first helically convoluted chamber, portions of the first cutting edge or the second cutting edge of each of the cutter disks.

14. The helical gear device of claim 13, further comprising:

a second section including a second helically convoluted chamber with a same pitch as the first helically convoluted chamber; and a cylindrical stator housing, the first section and the second section being secured within the cylindrical stator housing.

15. The helical gear device of claim 13, the stator further comprising:

a rigid sleeve defining a cylindrical chamber section for supporting the rotor.

16. The helical gear device of claim 13, wherein the cutter disks are metal disks.

17. The helical gear device of claim 13, wherein the cutter disks have a thickness along the common centerline between 0.1 inches and 1 inch.

18. The helical gear device of claim 17, wherein at least some of the cutter disks have a thickness along the common centerline of at least 0.5 inches.

19. The helical gear device of claim 13, wherein at least some of the cutter disks have a different thickness than other of the cutter disks.

20. A stator for a helical gear device, comprising:

a first section including a stack of cutter disks, each of the cutter disks including:

a front surface, a rear surface, an interior surface defining a central opening extending from the front surface to the rear surface, a first cutting edge along the front surface and the interior surface, and a second cutting edge along the rear surface and the interior surface, the interior surface forming a same number of lobes for the central opening as a set of radially inwardly extending lobes, each of the cutter disks being aligned along a common centerline, and each of the cutter disks being rotated slightly relative to each other such that the stack of cutter disks forms a first helically convoluted chamber with the set of radially inwardly extending lobes, wherein the interior surface of each of the cutter disks forms an acute angle along one of the first cutting edge or the second cutting edge, and wherein the first helically convoluted chamber in the stack of cutter disks exposes, to materials passing through the first helically convoluted chamber, portions of the first cutting edge or the second cutting edge of each of the cutter disks.

* * * * *